United States Patent [19]

Nakamura et al.

[11] Patent Number: 4,809,387

[45] Date of Patent: Mar. 7, 1989

[54] MOP WITH SQUEEZER

[75] Inventors: Kazuo Nakamura; Yasuaki Keiko, both of Osaka, Japan

[73] Assignee: Yamazaki Corporation, Osaka, Japan

[21] Appl. No.: 107,453

[22] Filed: Oct. 13, 1987

[30] Foreign Application Priority Data

Jun. 17, 1987 [JP] Japan ..... 62-151772

[51] Int. Cl.[4] ..... A47L 13/44

[52] U.S. Cl. ..... 15/119 R; 15/262

[58] Field of Search ..... 15/260–264, 15/115, 116.1, 116.2, 119 R, 119 A, 120 R, 120 A, 121

[56] References Cited

U.S. PATENT DOCUMENTS 2,521,445 9/1950 Brown ..... 15/119 R 3,946,457 3/1976 Robinson ..... 15/119 R

*Primary Examiner*—Peter Feldman

*Attorney, Agent, or Firm*—Wenderoth, Lind & Ponack

[57] ABSTRACT

A mop adapted to be squeezed by a pair of rollers mounted on the mop itself. The mop has a handle, a wiper, a squeezing cover, and a pair of rollers mounted in oblique guide slits formed in the squeezing cover. When the squeezing cover is moved down the handle, the rollers are guided to move toward each other so that the wiper caught between the rollers will be tightly squeezed by and between the rollers.

1 Claim, 2 Drawing Sheets

MOP WITH SQUEEZER

BACKGROUND OF THE INVENTION

The present invention generally relates to improvements in a mop and, more particularly, to a mop with a squeezer.

There is known a mop in which a tubular cover made of a synthetic resin is vertically movably mounted on its handle portion and its wiper portion is squeezed by forcing the cover downwardly over the wiper portion. However, because such a conventional mop is only provided with a tubular cover mounted on its wiper portion, the latter is not often squeezed satisfactorily.

SUMMARY OF THE INVENTION

An object of the present invention is to provide a mop whose wiper portion can be fully squeezed with a simple structure.

In accordance with the present invention, there is provided a mop with a squeezer comprising: a handle; a wiper fixedly mounted on the handle at one end thereof; a tubular squeezing cover mounted on the handle so as to be movable up and down for covering and squeezing the wiper; a clamping ring movably mounted on the squeezing cover for decreasing the diameter cover of the; the squeezing cover being formed with two pairs of oblique guide slits, the distance between one pair and the other reducing gradually toward top end thereof; and a pair of rollers loosely mounted in each pair of the guide slits and having both ends thereof passing through the guide slits.

According to the present invention, when the squeezing cover is forced down to surround the wiper portion, a pair of the rollers provided at the lower end of the squeezing cover press the wiper portion therebetween. Because the rollers are adapted to displace upwardly along the oblique guide grooves by forcing the squeezing cover downwardly and the distance between the rollers becomes shorter, the wiper portion is pressed tightly by the rollers so as to be squeezed sufficiently.

Further, according to the present invention, as the clamping ring fitted on the squeezing cover is screwed downwardly, the diameter of the squeezing cover becomes smaller gradually so that the distance between the rollers will be changed, thereby controlling the extent of squeezing of the wiper portion.

DESCRIPTION OF THE PREFERRED EMBODIMENT

Figure 1:
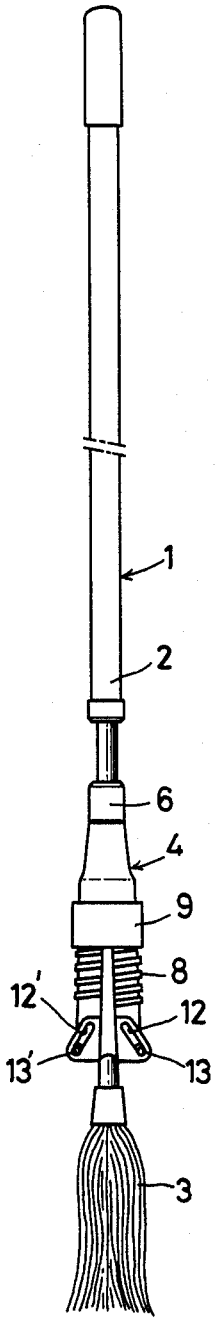
FIG. 1 is a front view illustrating one preferred embodiment of a mop according to the present invention.

A mop 1 is provided with a hanging wiper 3 at one end of a handle 2 which can telescopically extend and contract. A tubular squeezing cover 4 made of a synthetic resin for covering the wiper portion 3 is fitted on the handle 2 in such a manner as to move up and down.

Figure 2:
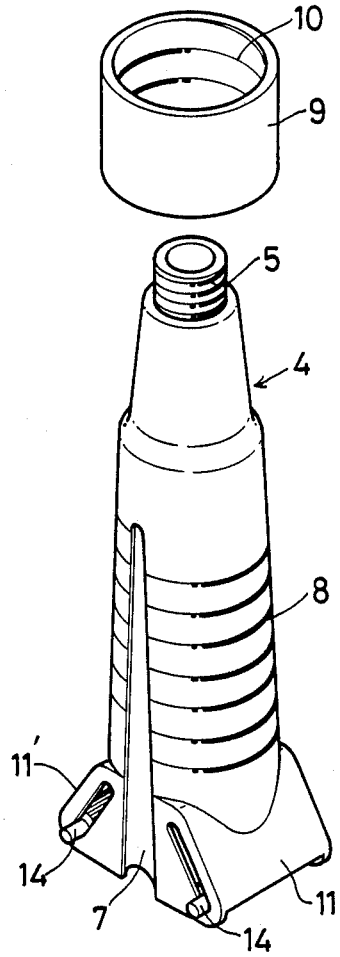
FIG. 2 is a partially exploded perspective view of the squeezing cover.
Figure 3:
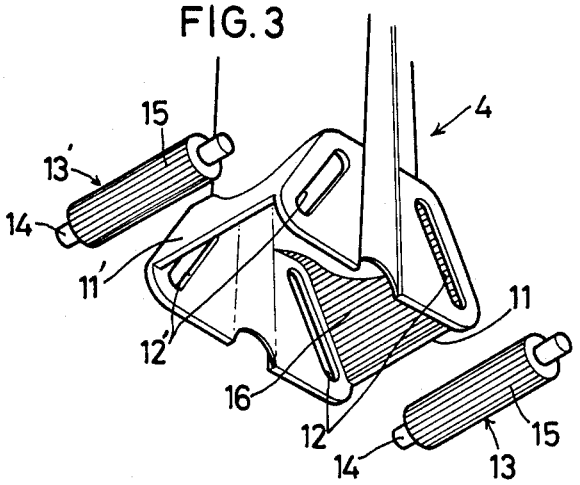
FIG. 3 is a perspective view of the lower end of the squeezing cover with its rollers removed.

The inner diameter of the squeezing cover 4 at its upper end is substantially equal to the outer diameter of the handle 2, and threads 5 are formed on the upper end of the cover 4. (FIG. 2) A fixing cap 6 is fitted on the threaded portion 5 to securely fix the squeezing cover 4 to the handle 2 by screwing the fixing cap 6 on the threads 5.

The squeezing cover 4 has a pair of flexible bending portions 7 at opposite sides, which allows the squeezing cover 4 to expand and shrink in diameter. Its diameter gradually increase downwardly. Threads 8 are formed on the outer periphery of the squeezing cover 4. A clamping ring 9 is threadedly mounted on the squeezing cover 4. Threads 10 adapted to engage the threads 8 are formed on the inner periphery of the clamping ring 9 so that the squeezing cover 4 will reduce its diameter as the clamping ring 9 is tightened downwardly.

Walls 11, 11' inclining inwardly with respect to each other are provided in a symmetrical relation at the lower end of the squeezing cover 4. A pair of oblique guide slits 12, 12' are formed on both sides of the sloping walls 11, 11'. These guide slits 12, 12' are arranged in a symmetrical relation so that the distance between them will gradually decrease upwardly. Rollers 13, 13' are fitted in the respective guide slits 12, 12' so as to be movable up and down. The rollers 13 and 13' are provided at both ends with shanks 14 adapted to be received in the guide slits 12 and 12'.

The rollers 13, 13' are formed with a plurality of axial teeth 15 on their periphery. Teeth 16 are also provided on the inner surface of the sloping walls 11, 11' to engage the teeth 15 on the rollers 13, 13'.

Figure 4:
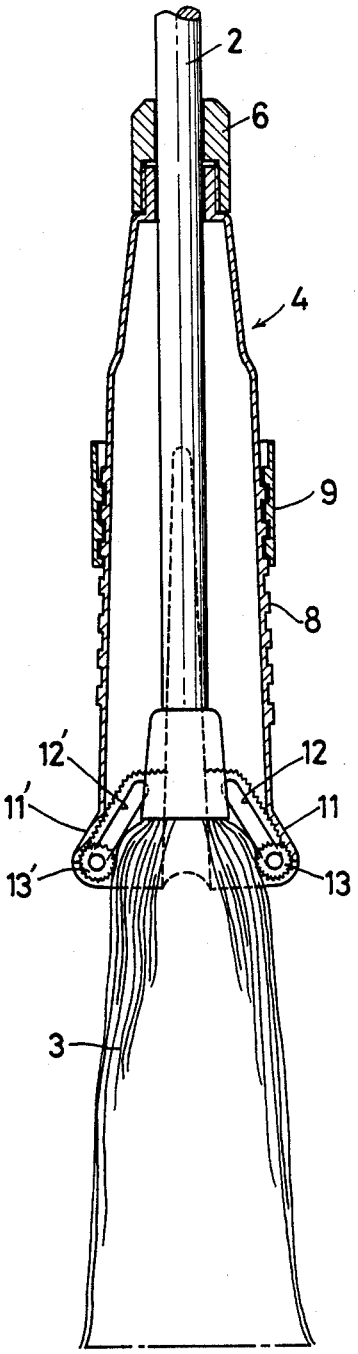
FIGS. 4 and 5 are partially cross-sectional views of the same showing how the mop is squeezed.
Figure 5:
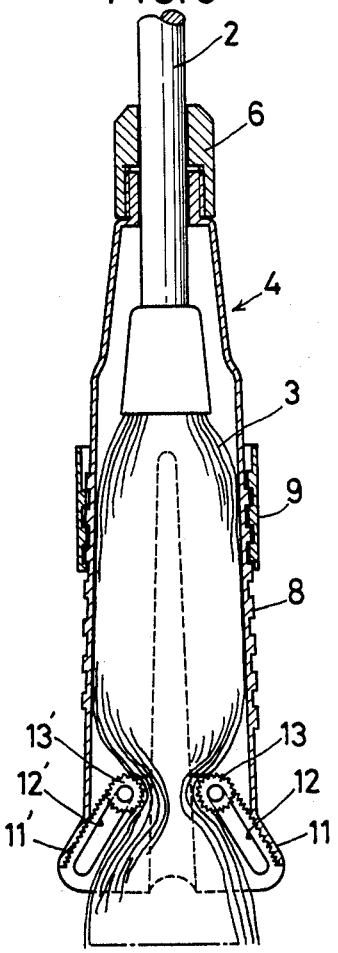

In use, in order to squeeze the wiper portion 3 of the mop 1, the fixing cap 6 in a condition shown in FIG. 1 is loosened and then the squeezing cover 4 is forced downwardly. Since the two rollers 13, 13' on the squeezing cover 4 are initially positioned at the lower end of the guide slits 12, 12' where the distance between the two rollers is at its maximum, the upper end of the wiper portion 3 is received in between the rollers 13, 13' as shown in FIG. 4. When the squeezing cover 4 is further forced down, the rollers 13, 13' will be pressed against the wiper portion 3 to rotate. While the teeth 15 of the rollers 13, 13' are in engagement with the teeth 16 on the sloping walls 11, 11', the rollers 13, 13' will move to the mop end of the guide slits 12, 12' as shown in FIG. 5 as the squeezing cover 4 is forced down. Thus the distance between the rollers 13, 13' is reduced, so that the wiper portion 3 is squeezed tightly between them.

Furthermore, when the clamping ring 9 fitted on the outer surface of the squeezing cover 4 is screwed downwardly, the diameter of the squeezing cover 4 at its lower end is reduced, so that the distance between the rollers 13, 13' is shortened, thereby regulating the extent of squeezing of the wiper portion 3.

On the other hand, when the squeezing cover 4 is drawn upwardly after the wiper portion 3 has been squeezed, the rollers 13, 13' will move back to the lower end of the guide slits 12, 12' and the distance between the rollers is extended, so that the squeezing cover 4 moves smoothly toward the upper part of the wiper portion 3. The fixing cap 6 is clamped to fix the squeezing cover 4 to the handle 2 to prevent the squeezing cover from falling off during cleaning after the squeezing cover has been moved to the upper part of the wiper portion.

As mentioned above, according to the present invention, the wiper portion can be squeezed securely merely by advancing the squeezing cover over the wiper portion of the mop.

What is claimed is:

1. A mop with a squeezer comprising:

a handle;

a wiper fixedly mounted on said handle at one end thereof;

a tubular squeezing cover movably mounted on said handle for moving up and down for covering and squeezing said wiper, said squeezing cover having a diameter gradually increasing downwardly and being elastically collapsible for decreasing its diameter, said squeezing cover having threads on an outer surface thereof, said squeezing cover having two pairs of oblique guide slits, the distance between one pair and the other pair of said guide slits decreasing gradually toward the top end of said squeezing cover, and a pair of rollers loosely mounted in each pair of said two pairs of guide slits and having both ends thereof passing through said guide slits; and a clamping ring movably mounted on said squeezing cover for clamping said squeezing cover for elastically decreasing the diameter of said squeezing cover for squeezing said wiper, and said clamping ring having threads on an inner surface thereof for threadedly engaging said threads on the outer surface of said squeezing cover for squeezing said squeezing cover for elastically decreasing the diameter of said squeezing cover for squeezing said wiper.

* * * * *